United States Patent [19]

Takanashi et al.

[11] 4,071,803

[45] Jan. 31, 1978

[54] ELECTRON GUN ASSEMBLY

[75] Inventors: Yukio Takanashi, Hiratsuka; Fumiyuki Sato, Kawasaki; Masanori Shinpo, Yokohama, all of Japan

[73] Assignee: Tokyo Shibaura Electric Co., Ltd., Kawasaki, Japan

[21] Appl. No.: 613,975

[22] Filed: Sept. 17, 1975

[30] Foreign Application Priority Data

Sept. 19, 1974 Japan ..... 49-107967
July 18, 1975 Japan ..... 50-99773[U]

[51] Int. Cl.[2] ..... H01J 29/02; H01J 29/50

[52] U.S. Cl. ..... 313/409; 313/270; 313/446

[58] Field of Search ..... 313/409, 411–414, 313/417, 446, 447, 270

[56] References Cited

U.S. PATENT DOCUMENTS

| | | | |
|---|---|---|---|
| 2,914,694 | 11/1959 | Chin | 313/446 X |
| 3,333,138 | 7/1967 | Szegho | 313/451 X |
| 3,728,574 | 4/1973 | Benda | 313/337 |
| 3,772,554 | 11/1973 | Hughes | 313/412 |

*Primary Examiner*—James B. Mullins
*Attorney, Agent, or Firm*—Oblon, Fisher, Spivak, McClelland & Maier

[57] ABSTRACT

The cathode electrode assembly of an electron gun assembly comprises an inner cathode cylinder supporting a base metal coated with an electron emitting material and an outer cathode cylinder coaxially supporting said inner cathode cylinder. Said outer cathode cylinder is supported at a first supporting point by a cathode holder fitted over said outer cathode cylinder. Said cathode holder is supported at a second supporting point by an electrode supporting piece supported by an insulating support pillar. Respective portions of the outer cathode cylinder and cathode holder are formed of the same quality of material.

9 Claims, 11 Drawing Figures

ELECTRON GUN ASSEMBLY

This invention relates to an electron gun assembly, and more particularly to a quickly emissive type electron gun assembly.

In a television receiver, it is desirable that when its switch is turned on, a picture comes out as quickly as possible and a stable picture is quickly obtained. Conventionally, a stand-by system wherein a heater of the cathode ray tube is preheated has been adopted to meet that demand. In this stand-by system, however, even when the television receiver is out of use, a power necessary to such preheating is consumed. This is not preferable from the standpoint of energy saving. Under these circumstances, such an electron gun assembly as, when the switch has been turned on, permits the cathode electrode to be quickly heated without being preheated goes on being developed.

Such a quickly heatable or quickly emissive type cathode electrode can be constructed using, for example, a chrome alloy as the cathode sleeve, such that the sleeve surface is oxidized and blacked in a wet hydrogen furnace during a cathode electrode manufacturing process; the heat radiation rate is increased up to, for example, 0.8 as compared with 0.2 in the case of a nickel sleeve to increase the heat radiation during a high temperature (stationary operation temperature)-operation; and a heater power compensating that increased thermal loss, for example a heater power about four times as large as the conventional power, per cathode capacity is supplied to the cathode electrode, whereby to raise quickly the temperature of the cathode electrode.

However, what should be here taken into consideration is first to form a cathode body comprised of a base metal coated with an electron emitting material and a cathode sleeve so as to have a small heat capacity, second to reduce thermal loss due to the heat transmission upon heat-rising, said first and second problems being raised for the purpose of saving a heater-heating power as much as possible, and third to eliminate the difficulties in supporting and assembling the cathode body necessarily miniaturized as a result of solving the first and second problems. The same reference applies also to, for example, a pick-up tube for use in a TV-telephone set other than the cathode ray tube.

In addition to the above-mentioned problems, it is also a great problem to control the variation of the cathode electrode-to-grid electrode's interval due to the temperature variation. Particularly in the case of a color television, arrangement should be so made, in order to obtain a white picture, that three electron beams emitted from the electron gun assembly have the current density. To this end, the three electron gun units constituting the three electron gun assembly have to be so constructed that the assembly is in a state wherein the respective cathode-to-grid's intervals of the gun units are always kept equal to each other. Conventionally, however, the cathode electrode, the grid electrodes and the supporting members supporting them are dimensionally varied due to the temperature variation occurring from the start of operation to the achievement of full operation. For this reason, the cathode-to-grid's interval is varied, so that the respective cathode-to-grid's intervals of the three electron gun units become unequal, so that a purely while picture fails to be obtained within a prescribed length of time after the switch has been turned on.

In order to solve the above-mentioned problems, various improvements have been made. According to, for example, U.S. Pat. No. 3,354,340, filed Oct. 14, 1966, patented Nov. 21, 1967, a cathode electrode haivng a heater received therein is coaxially supported, using supporting strips, by a supporting cylinder, and this supporting cylinder is supported by an insulating ring, and a cathode assembly thus obtained is attached to a cap-shaped grid electrode to constitute an integral structure. Since, in this type of electron gun assembly, the cathode assembly and the grid electrode are combined into one integral structure, the heat of the cathode electrode is transmitted to the grid electrode and as a result a so-called "grid emission" occurs, that is, thermoionic emission from the grid electrode is effected. Further, in this type of electron gun assembly, the cathode assembly is fitted to the grid electrode with the insulating ring interposed therebetween. Due to the differences in thermal expansion coefficient between the insulating ring, cathode assembly and grid electrode, these are dimensionally varied during operation, so that the cathode-to-grid intervals become unequal. On the other hand, U.S. Pat. No. 3,265,920 discloses an electron gun assembly wherein the cathode electrode and the grid electrodes are individually separately fitted to the insulating support pillars. This type of gun assembly, however, is of the type wherein electron emission is slow, that is to say, is not of a quickly emissive type. Namely, in the disclosed type of gun assembly, the cathode structure is not so constructed that countermeasure is taken toward the variation of the cathode-to-grid's interval due to thermal expansion.

An object of the invention is to provide a quickly emissive type electron gun assembly wherein the cathode-to-grid's interval is difficult to vary due to the temperature variation.

Another object of the invention is to provide a quickly emissive type electron gun assembly having a constitution capable of removing excessive heat constituted by small parts can be easily assembled.

According to the present invention, the cathode assembly comprises an inner cathode cylinder having a metal base coated with an electron emitting material, an outer cathode cylinder coaxially supporting said inner cathode cylinder through a plurality of supporting strips with a space formed between the inner and outer cathode cylinders, and a cathode holder supporting said outer cathode cylinder at a first supporting point and supported by an electrode supporting piece at a second supporting point, respective portions of said outer cathode cylinder and cathode holder falling between said first and second supporting points being formed respectively of materials having substantially the same thermal expansion coefficient. According to such constitution, the respective dimensional variations due to expansion, of said outer cathode cylinder and cathode holder before and after the filament ignition are mutually cancelled, so that the cathode-to-grid's interval is always kept substantially constant. Further, excessive heat is removed through a space between the inner and the outer cathodes so that a constant operation temperature is obtained.

This invention can be more fully understood from the following detailed description when taken in conjunction with the accompanying drawings, in which.

Figure 6:
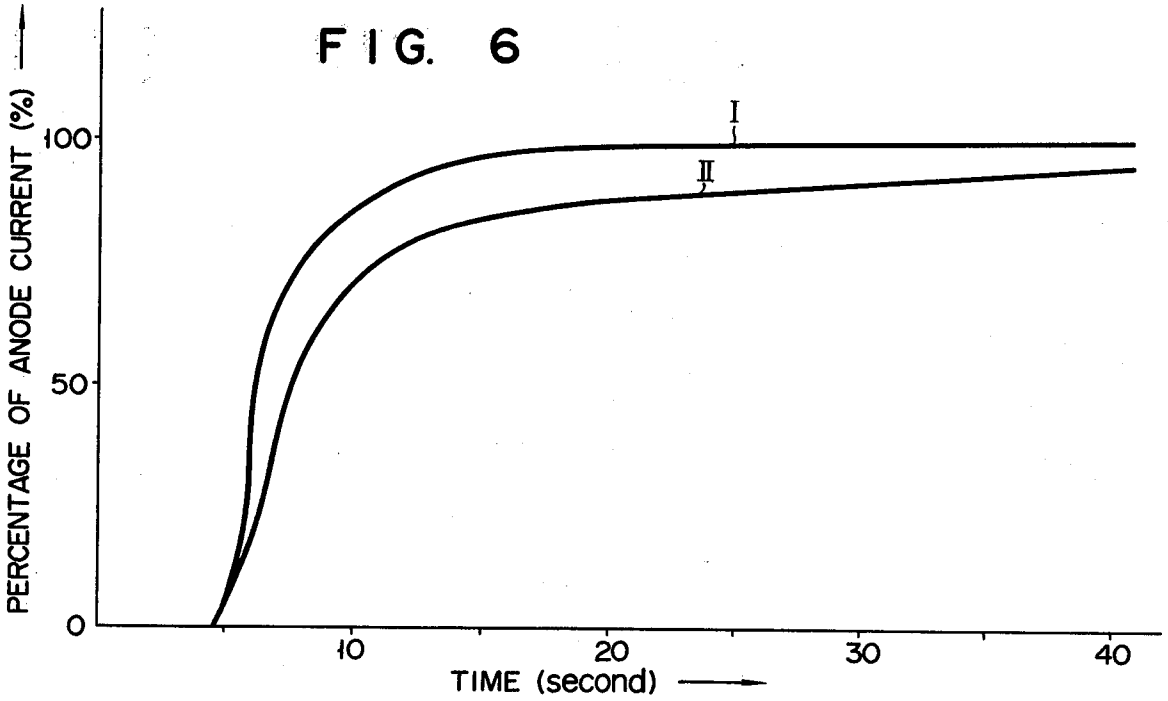
Figure 7:
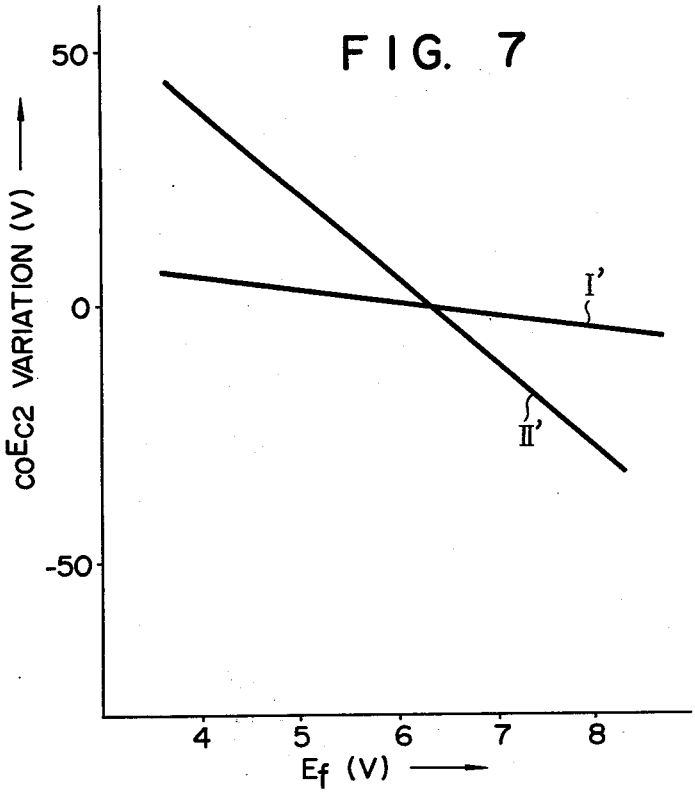
Figure 8:
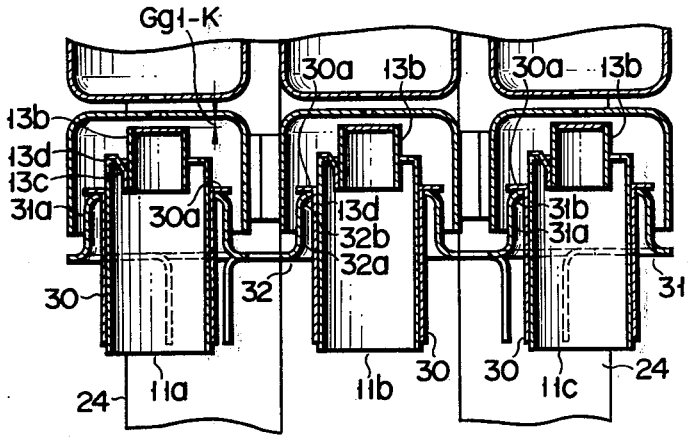
Figure 9:
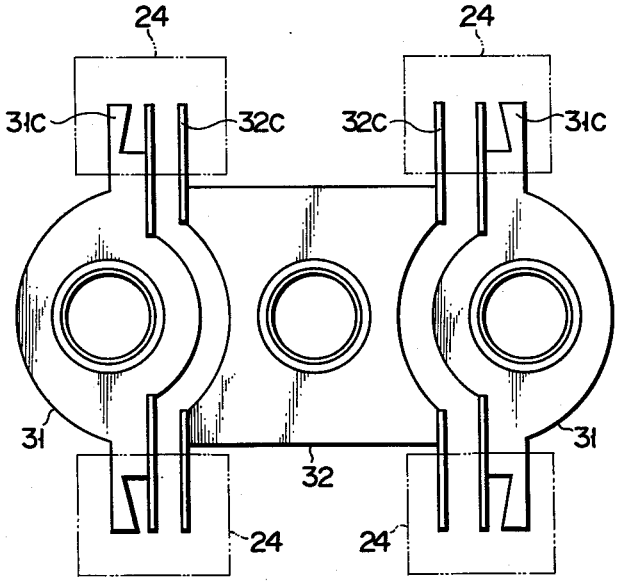
Figure 10:
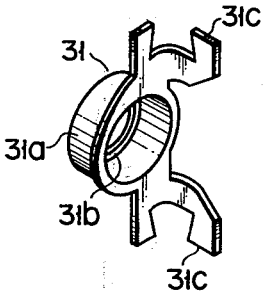
Figure 11:
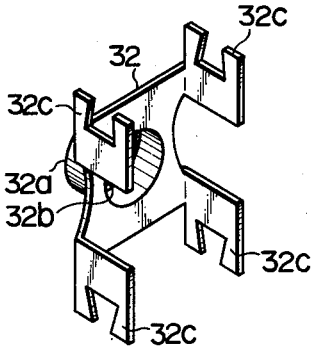

FIG. 6 graphically shows the increasing percentage of anode current with respect to the time passage from the heater ignition;

FIG. 7 graphically shows the variation of cut-off potential *co*Ec2 with respect to the variation of heater potential Ef;

FIG. 8 is a sectional view of the supporting structure of a cathode assembly according to another embodiment of the invention;

FIG. 9 is a sectional view taken along the line 9—9 of FIG. 8;

FIG. 10 is a perspective view of a strap of the cathode assembly of the side electron gun unit; and FIG. 11 is a perspective view of a strap of the cathode assembly of the central electron gun unit.

Figure 1:
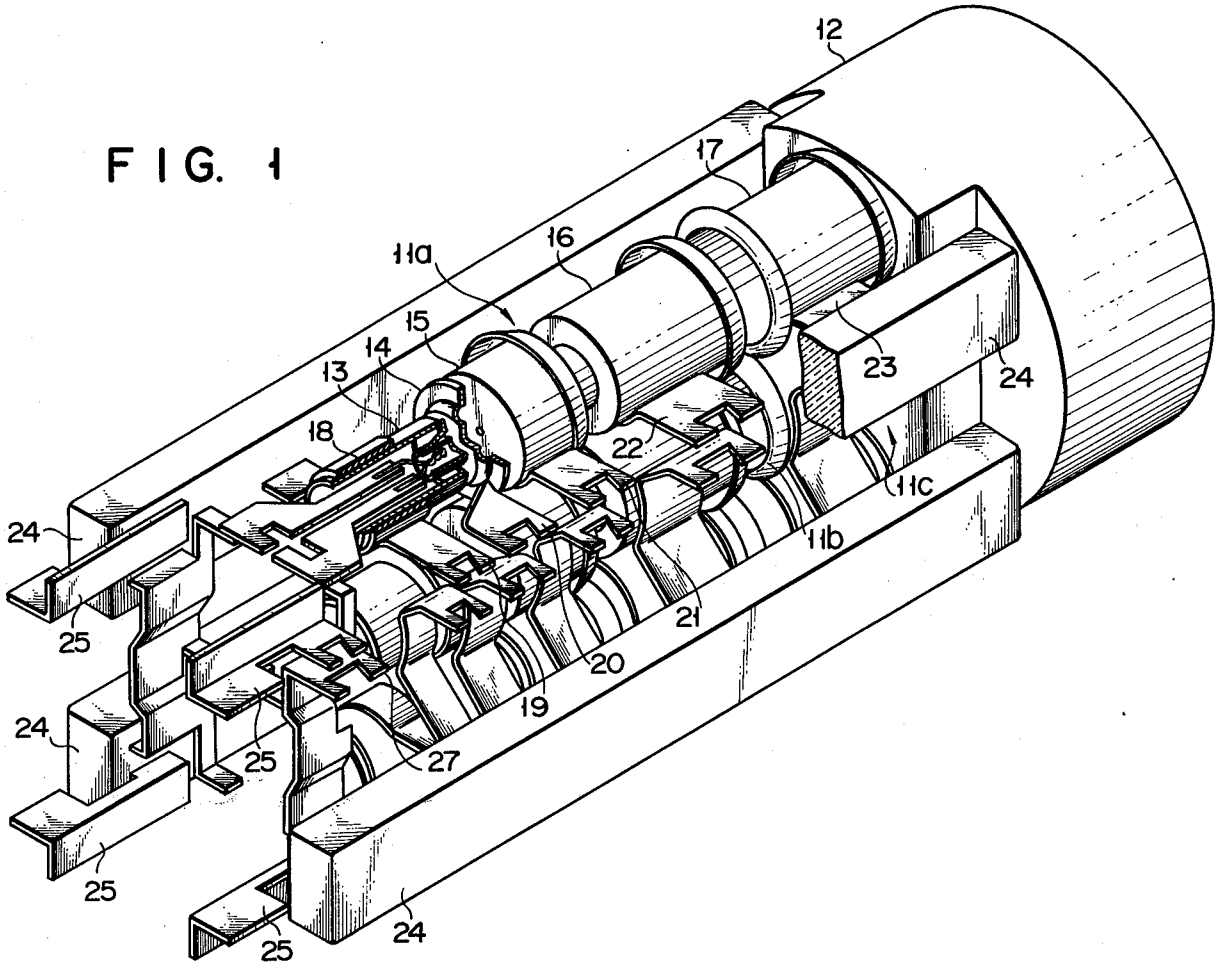
FIG. 1 is a perspective view of an electron gun assembly according to an embodiment of the invention.

In FIG. 1, a tri-electron gun assembly comprises three electron gun units 11*a*, 11*b* and 11*c* arranged in the same plane in prescribed convergence relationship and a converging cylinder 12 commonly provided on the tip ends of these three electron gun units. Each gun unit comprises a cathode electrode assembly 13, first grid electrode 14, second grid electrode 15, third grid electrode 16 and fourth grid electrode 17 which are coaxially arranged in sequential order, and a heater 18 provided in said cathode electrode assembly. To these electrodes 14 to 17 are fitted, respectively, electrode supporting pieces, i.e., straps 19, 20, 21, 22 and 23. To these straps are fitted three insulating support pillars, for example, three vitreous support pillars 24 axially of the tri-electron gun assembly in order to permit said three electron gun units 11*a*, 11*b* and 11*c* to be fixed into an integral assembly. The tri-electron gun assembly thus constructed is secured to a stem 26 by means of mount pieces 25 attached to ends of said insulating support pillars 24 on the cathode side, as shown in FIG. 2.

Figure 2:
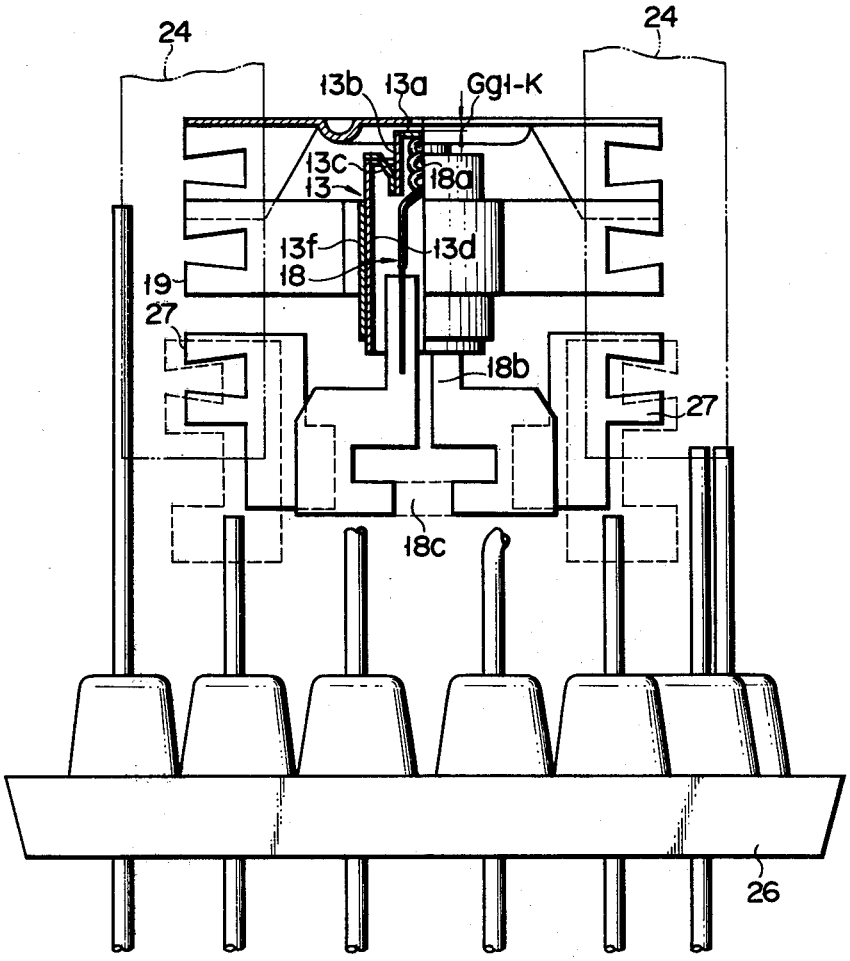
FIG. 2 is a side view, partly broken, of the cathode assembly.

In FIG. 2 showing the peripheral portion of a cathode assembly 13, said stem 26 is fused and sealed to a neck portion of a funnel shaped envelope (not shown) of a cathode ray tube and is intended to exteriorly draw out the electrodes of said tri-electron gun assembly.

Figure 3:
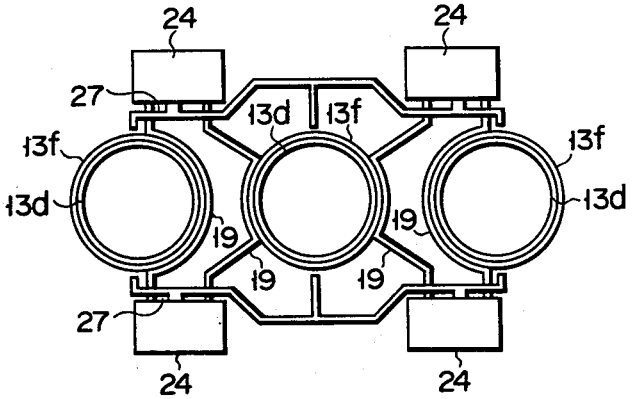
FIG. 3 is a cross sectional view taken along the line 3—3 of FIG. 1.
Figure 4:
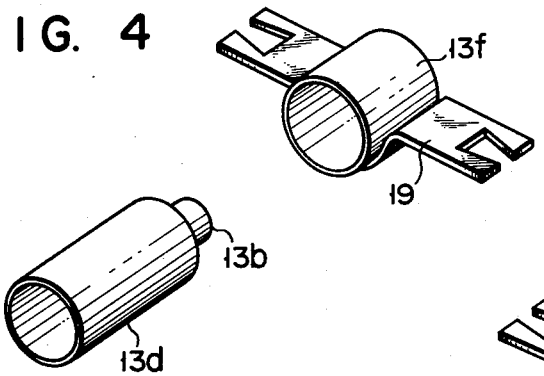
FIG. 4 is an enlarged perspective view of a cathode assembly of the side electron gun unit.
Figure 5:
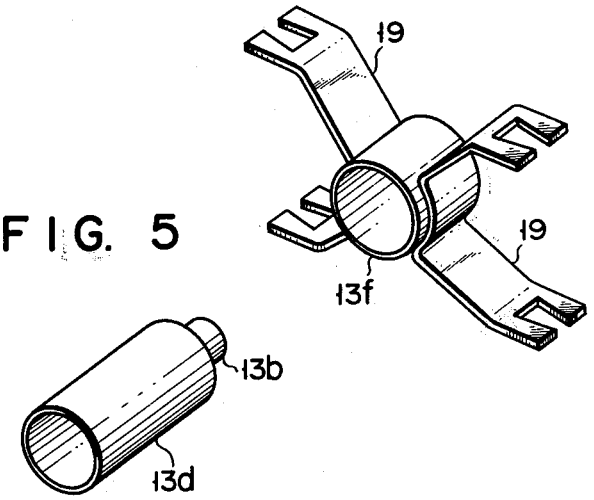
FIG. 5 is an enlarged perspective view of a cathode assembly of the central electron gun unit.

Said cathode assembly 13 has a cathode body 13*e* comprising an inner cathode cylinder 13*b* having a diameter of 1.9 mm and a length of 2.3 mm and having a base metal 13*a* coated with electron emitting material, and an outer cathode cylinder 13*d* having a diameter of 5 mm and coaxially supporting said inner cathode cylinder 13*b* on its tip end portion by three supporting strips 13*c* (only one supporting strip is shown) having a diameter of, for example, 5mm so that the tip portion of the inner cathode cylinder 13*b* is prosected from the tip end of the outer cathode cylinder. Since the inner cathode cylinder 13*b* is supported by the outer cathode cylinder 13*d* through said three supporting strips 13*c* obliquely fitted between the rear end of the inner cathode cylinder and the tip end of the outer cathode cylinder, transmission of the heat of the inner cathode cylinder 13*b* to the outer cathode cylinder is decreased and excessive heat is removed through a space between the inner and outer cathode cylinders. Further, since expansion of said supporting strips 13*c* obliquely provided so acts as to cancel an expanded portion of the inner cathode cylinder, the variation of the gap Ggl-*k* due to the expansion of the inner cathode cylinder does not take place. This cathode body 13*e* is fixed to a cathode holder 13*f* in a state wherein the outer cathode cylinder 13*d* is coaxially inserted into the cathode holder 13*f* secured to the strap 19. This cathode assembly is shown in detail in FIGS. 3, 4 and 5. Note that in FIGS. 4 and 5 the respective cathode assemblies of the side and central electron gun units are shown developed.

Upon constructing the above-mentioned cathode assembly, said cathode holder 13*f* is so constructed that the outer cathode cylinder 13*d* can be axially moved within the cathode holder 13*f*. For example, where the outer cathode cylinder 13*d* has an outer diameter of 5 mm, the cathode holder 13*f* preferably has an inner diameter 0.02 to 0.08 mm larger than the outer diameter of the outer cathode cylinder. The outer cathode cylinder 13*d* and the cathode holder 13*f* are separately manufactured so as to have such dimensional relationship with each other, and the outer cathode cylinder 13*d* is fitted with the inner cathode cylinder 13*b* thus to construct said cathode body 13*e*. When the cathode body 13*e* is fitted to the cathode holder 13*f*, the cathode body 13*e* is inserted into the cathode holder 13*f* so as to permit the electron emitting material layer of the metal base 13*a* to face the first grid electrode 14. At this time, said insertion is carried out while the gap Ggl-*k* between the first grid electrode 14 and the cathode electrode 13 is being measured using an air micrometer, and when said gap Gg1-*k* has a prescribed value, the outer cathode cylinder 13*d* is welded and fixed to the cathode holder 13*f*.

In fitting the heater 18, a filament 18*a* and a conductive frame 18*b* supporting said filament 18*a* and concurrently functioning as a lead are assembled in another step, and this filament assembly is disposed in the cathode assembly 13 in a state wherein the filament 18*a* is inserted into the inner cathode cylinder 13*b*. After the conductive frame 18*b* of the filament assembly has been welded to straps 27 fused respectively to the insulating support pillars 24, a portion 18*c* of said conductive frame 18*b* is notched.

When, in the electron gun assembly having the abovementioned construction, the gap Gg'*1-k* between the first grid electrode 14 and the cathode electrode 13 has the following relationship:

$$Ec1 = \frac{Dg1^3 \times k}{Gg1 - k \times Gg1 - g2 \times Tg1} \times Ec2 \qquad (1)$$

where Ggl—*g*2 represents the gap between the first and second grid electrodes 14, 15T*g*1 the wall thickness of the first grid electrode 14, D*g*1 the hole diameter of the first grid electrode, *k* the correcting coefficient, E*c*1 the potential of the first grid electrode, and E*c*2 the potential of the second grid electrode. The anode current is set at max. Ik of the equation: max. I*k-k'* × *co*E*c*1$^{3/2}$ established when the cathode electrode is operating within a region of space charge. This max. I*k* is equal to the amount of anode current when the E*c*1 is kept at a level of rated voltage and, by varying the E*c*2 with the second grid taken as an anode electrode, the E*c*2 is set to a beam cut-off voltage and thereafter the E*c*1 is set to a bias voltage of zero.

As apparent from the equation (1), when the Gg1-*k* is varied due to the thermal expansion, etc. after ignition of the heater, the anode current is varied in proportion to the 3/2 power of the cut-off voltage (*co*Ec1). In a stable condition after ignition of the heater, the Gg1-*k* (which is electrically expressed by a cut-off potential) can be set at a given value, but during a certain period of time beginning from heater ignition the Gg1-*k* is gradually reduced from a value before heater ignition as the temperature of the associated parts is increased, so that the anode current (in the case of a Braun tube, current flowing in the fluorescent screen) is gradually increased. This increasing amount of anode current is not only varied depending upon the temperature and thermal expansion coefficient of the associated parts but also does not always flow only in a fixed direction on account of, for example, the configuration of the structure, and particularly a strap of the configuration wherein its both ends are fixed is laterally displaced, inclined, etc., so that the variation in amount of the anode current does not always picture a fixed curve. To manufacture, in order to avoid this, a strap of the configuration wherein its both ends are not fixed is in fact difficult, and such configuration of strap has never been put to practical use. Particularly in the case of a color Braun tube comprised of three electron gun units, there is little possibility that respective kaleidoscopic dimensional variations of the three electron gun units occur in harmony with each other, and therefore these dimensional variations should be considered as occurring in an irregular manner. These dimensional variations appear as an anode current variation, accordingly as an unbalance between the current amounts of the three electron gun units. Although the color adjustment is performed by so adjusting the current of the three electron gun units as to permit a white picture screen to be obtained when this amount of current is maximum (this matter is hereinafter referred to as "white balance", which is expressed by W/B), occurrence of said dimensioned variations due to the reignition after the tube is switched off causes the color displacement, so that the picture does not become normal until the dimension of the three electron gun units becomes stable.

As one of the methods of removing the above-mentioned drawbacks it is contemplated that the cathode cylinder 13*d* and cathode holder 13*f* are formed of material having a small thermal expansion coefficient. By so doing, for example, such results as shown in FIG. 6 are obtained. FIG. 6 is a characteristic curve diagram wherein a curve I represents the anode current characteristic of a cathode electrode formed of a Fe—Ni—Co alloy (known under the trade name of (KOVAR) based material having a relatively low expansion coefficient and a curve II the anode current characteristic of a cathode electrode formed of a Fe—Cr—Ni alloy base d material having a relatively high expansion coefficient, with a time length after switch-on of the tube plotted on the abscissa, and anode current values plotted on the ordinate, said anode current values being those at respective points of times in the case where a length of time for permitting a complete stabilization of electron gun assemblies using said respective cathode electrodes is taken as about 200 seconds and this period of 200 seconds is taken as 100. As seen from FIG. 6, between both electron gun assemblies little difference exists in respect of a time length required from switch-on of the tube to the start of electron emission, an about 1-second difference exists in respect of a time length required from switch-on of the tube to the time when the picture is clearly seen (an anode current of about 50%), and an about 15-second difference exists in respect of a time length required from switch-on of the tube to the time when a substantially complete picture is obtained (an anode current of about 90%). These phenomena result from the comparison between the cathode electrodes wherein electron emission is normal, all occur within a space charge-limiting region, and originate in an occasional structural preveance as measured in terms of temperature. Therefore, the above-mentioned curve patterns can not be varied through varying the exhausting and aging conditions in the steps of manufacturing the electron gun assembly. Further, it is impossible to achieve the "white balance" even through varying the cathode-to-first grid's interval and the level of voltage applied. FIG. 7 shows the relation between the variation in the potential of the heater E*f* (abscissa) and the variation in the cut-off potential *co*Ec2 when the electron beam is cut off with the Ec1 set at -100V and the Ec2 varied (ordinate), in a sufficiently thermally stabilized condition. As seen from FIG. 7, one curve I' representing a cathode electrode formed of material having a low thermal expansion coefficient presents a smaller variation than the other curve II'. It will be understood that at the respective points of times of FIG. 6 as elapsed after ignition of the heater the variation of the gap between the first grid and cathode electrodes due to the variation in the temperature of the associated parts affects the amount of anode current.

Another one of the methods of eliminating the above-mentioned drawbacks is to reduce the effective length of the expansible members such as the outer cathode cylinder 13*d*. To this end, the cathode holding strap 19 and the cathode holder 13*f* are so constructed that their respective lengths extending toward the electron emission plane of the cathode from a fusing point at which 19 is fused to 13*f* may become as small as possible, and at least respective portions of the cathode holder 13*f* and cathode cylinder 13*d* falling between said fusing point and a securing point between 13*f* and 13*d* are made of the same quality of material, for example, KOVAR into a cylindrical shape, thereby permitting said respective portions to cancel their mutually opposite expanding actions, thus zeroing the effective length of said respective portions. For this reason, the effective length of the outer cathode cylinder 13*d* as resulting from expansion is determined only by the distance from said fusing point to the tip end of the outer cathode cylinder. From the above-mentioned point of view, the fusing point between the cathode holding strap 19 and the cathode holder 13*f* preferably is determined at a position as near to the tip end of the outer cathode cylinder as possible. It is sometimes synthetically preferable, with a view to avoiding strap distortions due to the fixation, of the holding strap 1*a* at its both ends, that said fusing point is set at a central portion of the strap width. In this case, the directions in which the respective members such as 19, 13*f*, 13*d*, 13*b*, etc. extend due to their thermal expansions are as follows. The strap 19 extends mainly in a lateral direction but little extends in a direction permitting the gap Gg1-*k* between the first grid and cathode electrodes to be varied. Further, in the case of comparison between the holder 13*f* and the strap 19, the holder 13*f* extends toward the cathode side of the electron gun assembly, whereas in the case of comparison between the holder 13*f* and the cathode cylinder 13*d*, the cylinder 13*d* extends toward the anode side of the electron gun assembly. Accordingly, the holder 13*f* and the cathode cylinder 13*d* cancel their mutually opposite expanding actions to permit a reduction of the variation with temperature of the gap between the first grid and cathode electrodes, thus preventing the W/B (white balance) from being lost. Further, the first grid electrode 14, cathode electrode assembly 13 and heater 18 are respectively independently attached to the insulating support pillars 24. Therefore, it little happens that the electrode 14, assembly 13 and heater 18 affect each other to vary the first grid-to-cathode's interval. Further, the amount of heat applied to the cathode electrode is rapidly decreased by the supporting strips 13*c* but the temperature gradient of the remaining portions 13*d*, 13*f* and 19 is gentle. Further, if the outer cathode cylinder 13*d* and the cathode holder 13*f* are formed of the same quality of material, both of them can be regarded as being heated at almost the same temperature (for example, at about 3500° C). For the foregoing reasons, according to the structure of the present invention, it is possible to extend axially the cathode holder 13*f* and the outer cathode cylinder 13*d* without taking into consideration the effect upon the gap between the first grid and cathode electrodes. Further, according to the present invention, an overlapped portion of the cathode holder 13*f* upon the cathode cylinder 13*d* can be elongated, which offers many advantages—for example, the cathode cylinder 13*d* is prevented from being inclined due to a clearance between both 13*d* and 13*f*, the parallelism between the first grid and cathode electrodes is less deteriorated, the cut-off voltage variation is reduced, and so on.

In FIGs. 8 to 11, another embodiment of the cathode assembly-supporting structure is shown. In this embodiment, a cathode holder 30 supporting the cathode body 13*e* comprised of the inner cathode cylinder 13*b* and the outer cathode cylinder 13*d* has a flange portion 30*a*. The respective cathode holders 30 of side electron gun units 11*a* and 11*c* are secured to electrode supports or plate-like straps 31 in a manner that the flange portions 30*a* of the cathode holders 30 are welded respectively to the inner flanges 31*b* of cylindrical portions 31*a* of the plate-like straps 31 shown in FIG. 10. The cathode holder 30 of a central electron gun unit 11*b* is welded to a plate-like strap 32 shown in FIG. 11 in a manner that the flange 30*a* of the cathode holder 30 is welded to the inner flange 32*b* of a cylindrical portion 32*a* of said plate-like strap 32. These straps 31 and 32, as shown in FIG. 9, are attached to the insulating support pillars 24 through their attaching ends 31*c* and 32*c*, respectively.

Suppose now that in the above-mentioned construction the outer cathode cylinder 13*d* and cathode holder 30 are formed respectively of materials having substantially the same expansion coefficient. Then, in portions of the cathode assembly between a first welded point between the cathode holder 30 and the flange 31*b* (32*b*) of the strap 31 (32), and a second welded point, for example, at a lower part of the illustration between the outer cathode cylinder 13*d* and the cathode holder 30, the respective dimensional increases due to expansion, of the outer cathode cylinder 13*d* and cathode holder 30 are mutually cancelled, so that the gap G*g*1-*k* between the cathode assembly 13 and the first grid 14 remains unvaried. Accordingly, the gap variation after and before the filament ignition little occurs, so that a good "white balance" is achieved. The preceding embodiments referred to the in-line type tri-electron gun assembly but it will be evident that this invention can be applied also to a single electron gun assembly and Δ-type tri-electron gun assembly.

What we claim is:

1. An electron gun assembly comprising at least one electron gun unit constituted by a cathode electrode assembly having an inner cathode cylinder, a heater located in said inner cathode cylinder, and an outer cathode cylinder coaxially supporting the inner cathode cylinder; a plurality of grid electrodes sequentially arranged coaxially with the cathode electrode assembly; electrode supporting pieces for supporting the cathode and grid electrodes, the electode supporting pieces being fitted to one or more insulating support pillars, the inner cathode cylinder being supported to the tip end portion of the outer cathode cylinder by a plurality of supporting strips so that the tip portion of said inner cathode cylinder is projected from the tip end of the outer cathode cylinder and having a diameter small enough so that there is formed between the inner and outer cathode cylinders a space to effectively disperse heat; the outer cathode cylinder being inserted in and fitted to a cylindrical cathode holder at first supporting points in the axial direction of the outer cathode cylinder, the cylindrical cathode holder being fitted to a supporting piece at second supporting points in the axial direction of the outer cathode cylinder which are separated from the first supporting points, respective portions of the outer cathode cylinder and cathode holder, at least between the first and second supporting points, being formed respectively of materials having substantially the same thermal expansion coefficient.

2. An electron gun assembly according to claim 1 wherein said inner and outer cathode cylinders are formed of the same quality of material.

3. An electron gun assembly according to claim 2 wherein said quality of material is KOVAR.

4. An electron gun assembly according to claim 1 wherein said electrode supporting piece fitted to said cathode holder of said cathode electrode assembly is band-shaped.

5. An electron gun assembly according to claim 1 wherein said electrode supporting piece fitted to said cathode holder is constituted by a flat plate-shaped electrode supporting piece having a cylindrical portion being fitted over said cathode holder.

6. An electron gun assembly according to claim 5 wherein said cathode holder supporting said outer cathode cylinder has a tip end portion formed with an outwardly projected flange, and said cylindrical portion of said flat plate-shaped electrode supporting piece has a tip end portion formed with an inwardly projected flange being allowed to abut on said outwardly projected flange of said cathode holder.

7. An electron gun assembly according to claim 6 wherein said outer cathode cylinder is welded to, and supported by, a rear end portion of said cathode holder, and said cathode holder is supported by said electrode supporting piece in such a manner that said inwardly projected flange of said electrode supporting piece is welded to said outwardly projected flange of said cathode holder.

8. An electron gun assembly according to claim 1 wherein said heater, said cathode electrode assembly and said grid electrodes are individually separately supported by an insulating support pillar.

9. An electron gun assembly comprising three electron gun units arranged in-line with each constituted by a cathode electrode assembly having an inner cathode cylinder having a metal base coated with electron emitting material, a heater located in the inner cathode cylinder and an outer cathode cylinder coaxially supporting the inner cathode cylinder; a plurality of grid electrodes sequentially arranged coaxially with the cathode electrode assembly; electrode supporting pieces for supporting the cathode and grid electrodes, the electrode supporting pieces being fitted to one or more insulating support pillars, the inner cathode cylinder being supported to the tip end portion of the outer cathode cylinder by a plurality of supporting strips so that the tip portion of said inner cathode cylinder is projected from the tip end of the outer cathode cylinder and having a diameter small enough so that there is formed between the inner and outer cathode cylinders a space to effectively disperse heat; the outer cathode cylinder being inserted in and fitted to a cylindrical cathode holder at first supporting points in the axial direction of the outer cathode cylinder, the cylindrical cathode holder being fitted to a supporting piece at second supporting points in the axial direction of the outer cathode cylinder which are separated from the first supporting points, respective portions of the outer cathode cylinder and cathode holder, at least between the first and second supporting points, being formed respectively of materials having substantially the same thermal expansion coefficient.

* * * * *